United States Patent [19]

Holden et al.

[11] Patent Number: 4,557,410

[45] Date of Patent: Dec. 10, 1985

[54] STAPLER MECHANISM POWERING MEANS

[75] Inventors: Chester D. Holden, Boulder; Allan J. Rood, Longmont, both of Colo.

[73] Assignee: International Business Machines Corporation, Armonk, N.Y.

[21] Appl. No.: 527,725

[22] Filed: Aug. 30, 1983

[51] Int. Cl.[4] ..... B25C 7/00; B21J 15/28

[52] U.S. Cl. ..... 227/155; 227/7; 227/131; 74/44; 74/55

[58] Field of Search ..... 227/111, 129, 131, 155, 227/7, 133; 74/44, 55, 569

[56] References Cited

U.S. PATENT DOCUMENTS

| | | | |
|---|---|---|---|
| 183,670 | 10/1876 | Heyl . | |
| 237,291 | 2/1881 | Keith . | |
| 908,243 | 12/1908 | Gminder | 227/117 |
| 1,152,534 | 9/1915 | Mears et al. . | |
| 1,495,139 | 5/1924 | Johnson . | |
| 1,498,645 | 6/1924 | Craig . | |
| 2,564,969 | 8/1951 | Goldberg | 74/45 |
| 2,650,360 | 9/1953 | Nardone | 227/131 |
| 2,961,067 | 11/1960 | Starr | 74/45 |
| 3,110,033 | 11/1963 | Crim | 227/7 |
| 3,502,255 | 3/1970 | Hermann et al. | 227/7 |
| 4,281,920 | 8/1981 | Cross | 355/75 |
| 4,344,554 | 8/1982 | Cross | 227/155 |

FOREIGN PATENT DOCUMENTS

| | | | |
|---|---|---|---|
| 0708120 | 7/1931 | France | 198/858 |
| 0014280 | of 1903 | United Kingdom | 227/85 |

*Primary Examiner*—Paul A. Bell
*Assistant Examiner*—Taylor J. Ross
*Attorney, Agent, or Firm*—Francis A. Sirr; Carl M. Wright

[57] ABSTRACT

Stapler mechanism drive unit utilizing a high-speed, low-inertia flywheel with a combination bellcrank and cam power-delivering arrangement for furnishing power to a stapler driver and clincher.

2 Claims, 4 Drawing Figures

STAPLER MECHANISM POWERING MEANS

TECHNICAL FIELD

This invention relates to powered stapler mechanisms and particularly to medium-sized copier finisher staplers.

Staplers used in the finishers of copier and duplicating machines have duty cycle and power requirements that fall between those of most available systems. More power is required and the duty cycle is greater than general office use staplers, but the available installation space is insufficient for mounting the large industrial models, which are also undesirable for economical reasons.

For use in copier finishers, it is desirable to have a stapler driver that is capable of handling a heavy duty cycle with sufficient power to handle medium-sized loads and still be small enough in size to be installed in a restricted spaced. It is also desirable that such stapler drivers be able to handle a range of loads within their design limits.

BACKGROUND ART

Current stapler or stitcher drive units use large motors, on the order of ⅓-horsepower or greater, with flywheels approximately 1½ to 2 feet in diameter. Such high-powered systems are needed for the high duty cycle rates commonly employed with commercial units, usually in the range of 230 staples per minute.

Small powered staplers, such as those used in offices for general paper fastening, are usually solenoid driven and are used at a very low duty cycle. There is a limit to the number of paper sheets that such staplers can handle.

The prior art shows various mechanisms for driving staples. For example, U.S. Pat. No. 183,670 shows a book stitching machine with rapidly rotating drills for drilling small holes to receive the staples, permitting large books to be stitched.

Another book stitcher patent, U.S. Pat. No. 237,291, illustrates an improved clincher. Still another book stitcher is shown in U.S. Pat. No. 1,152,534 which is arranged to insert a staple and clinch it so that the staple length is slightly wider than the book thickness to permit the pages to move.

Box staplers are illustrated by U.S. Pat. Nos. 1,495,139 and 1,498,645 which show elongated fixtures for permitting staples to be driven from inside the box. Various cam and eccentric driving arrangements are shown in these patents.

U.S. Pat. No. 4,281,920 shows a stapler for a copier finisher directed to placing the staples in the sheets at an angle relative to the edges of the corner. The stapler used is described as either the solenoid or cam operated type. The stapler details are not shown.

DISCLOSURE OF THE INVENTION

In accordance with the present invention, a stapler mechanism is provided with a driver that includes a single-revolution clutch coupling a motor to a combination bellcrank and cam unit which furnish, respectively, power to a connecting rod to operate the stapler driver mechanism and to a clincher for bending over the ends of the driven staple. A flywheel is used to store energy from the motor which is delivered back to the system when the motor rotation tends to decrease because of the load when a solenoid engages the clutch to operate the combination bellcrank and cam.

The advantages of the system according to the invention include small size with medium driving power capability. The compactness of the unit resulting from the use of the combination bellcrank and cam device makes it useful in the finishers of copiers, printers, duplicators, and the like.

The driver according to the invention is also adaptive in that the motor stores more energy in the flywheel for a greater number of sheets to be stapled because more time is required to make the greater number of copies and the motor runs longer before the staple is driven. With only a few sheets, less driving power is required but the motor does not run as long before driving the staple.

The invention permits the motor size to be reduced by a factor of more than four by taking advantage of the duty cycle requirements of office equipment. The duty cycle in a copier is reduced because of the time required to accumulate the sheets that are to be stapled, the average rate being about 75 staples per minute.

The flywheel diameter has been reduced by placing the flywheel on the motor shaft instead of on the gearing output as is done on the prior art machines. Placing the flywheel on the input side of the gearing instead of the output side permits the use of a high-speed, low-inertia flywheel. This permits the motor to be turned off until approximately 10 seconds before a stapling operation is required. That is, the controller of the copier provides a signal that indicates the stapler will be needed in about 10 seconds and the signal so provided can be used to start the motor. Because of the low inertia, the flywheel can get up to speed in that time. There is, however, an increased strain on the gearing because it must transmit impulse forces.

DETAILED DESCRIPTION

Figure 1:
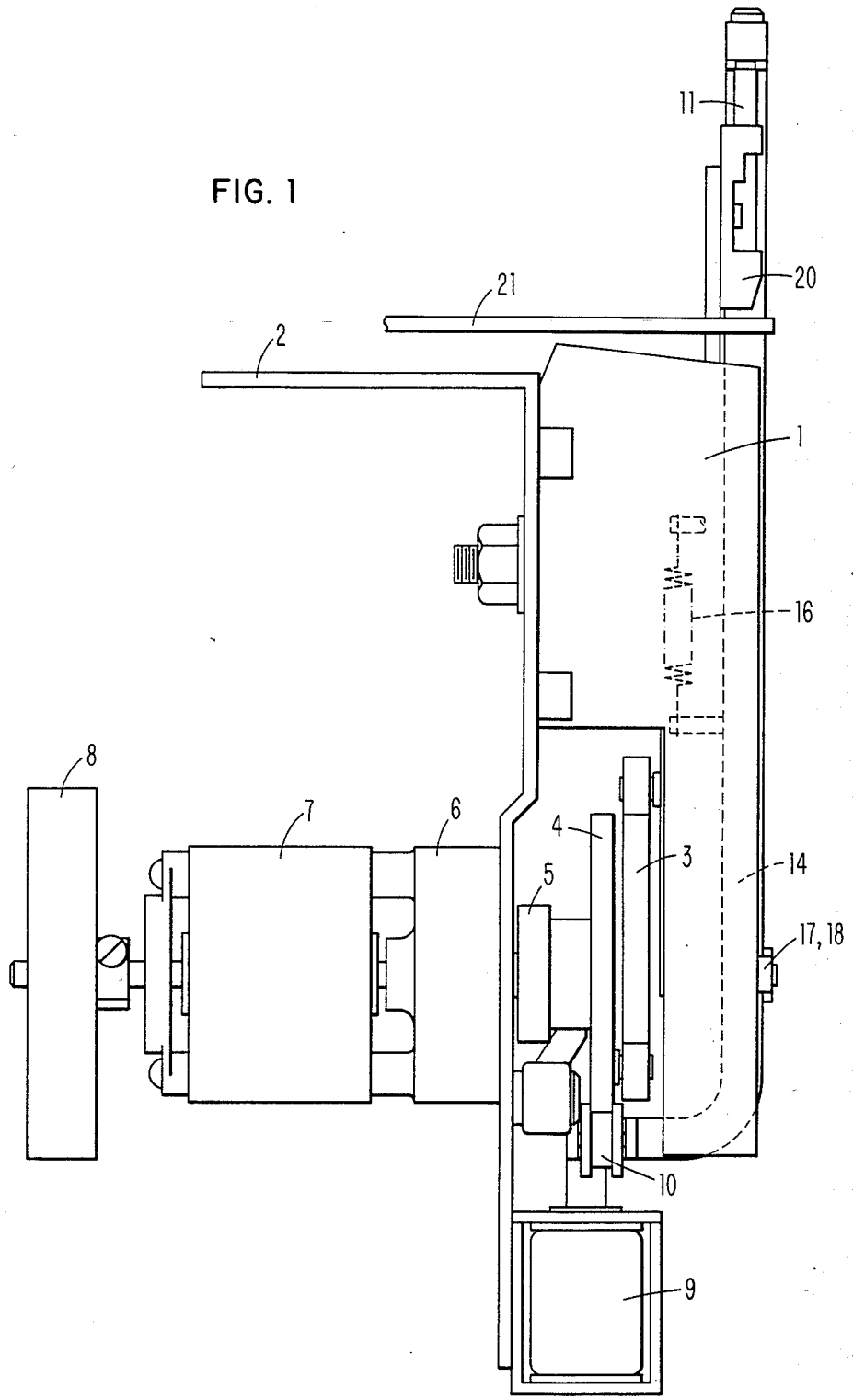
FIG. 1 is a side elevated view of the driver mechanism according to the invention.

A preferred drive system for a stapler useful in a copier finisher is illustrated in FIG. 1. The stapler mechanism 1 is a commercially available unit such as the Ministitcher manufactured and sold by the Bostitch Corporation. The driver apparatus must be supplied by the user or purchased separately.

The driver shown in FIG. 1 includes a motor 7 which is coupled to a gear box 6 which is, in turn, coupled to a single-revolution clutch 5. The clutch 5 is coupled to a combination bellcrank and cam 4, an integral unit that serves a dual function as described in more detail below.

A connecting rod 3 couples the bellcrank portion of the combined bellcrank and cam 4 to the stapler mechanism 1 to provide the power to operate the stapler to drive staples through articles to be stapled.

A cam follower 10 operates the clincher device 11 when powered from the cam portion of the combination bellcrank and cam 4. The purpose of the clincher 11 is to fold over the ends of the staple driven through the articles to be stapled, in most cases sheets of paper.

A solenoid 9 is used to engage the single-revolution clutch 5 to cause the stapler mechanism 1 to drive and to clinch a single staple in the articles to be stapled.

A flywheel 8 is provided to store energy that is returned to the system when the solenoid 9 is actuated to engage the single-revolution clutch 5 and the system energy is imparted to the stapler mechanism 1.

A bracket 2 forms part of the mounting hardware for the stapler system.

Figure 2:
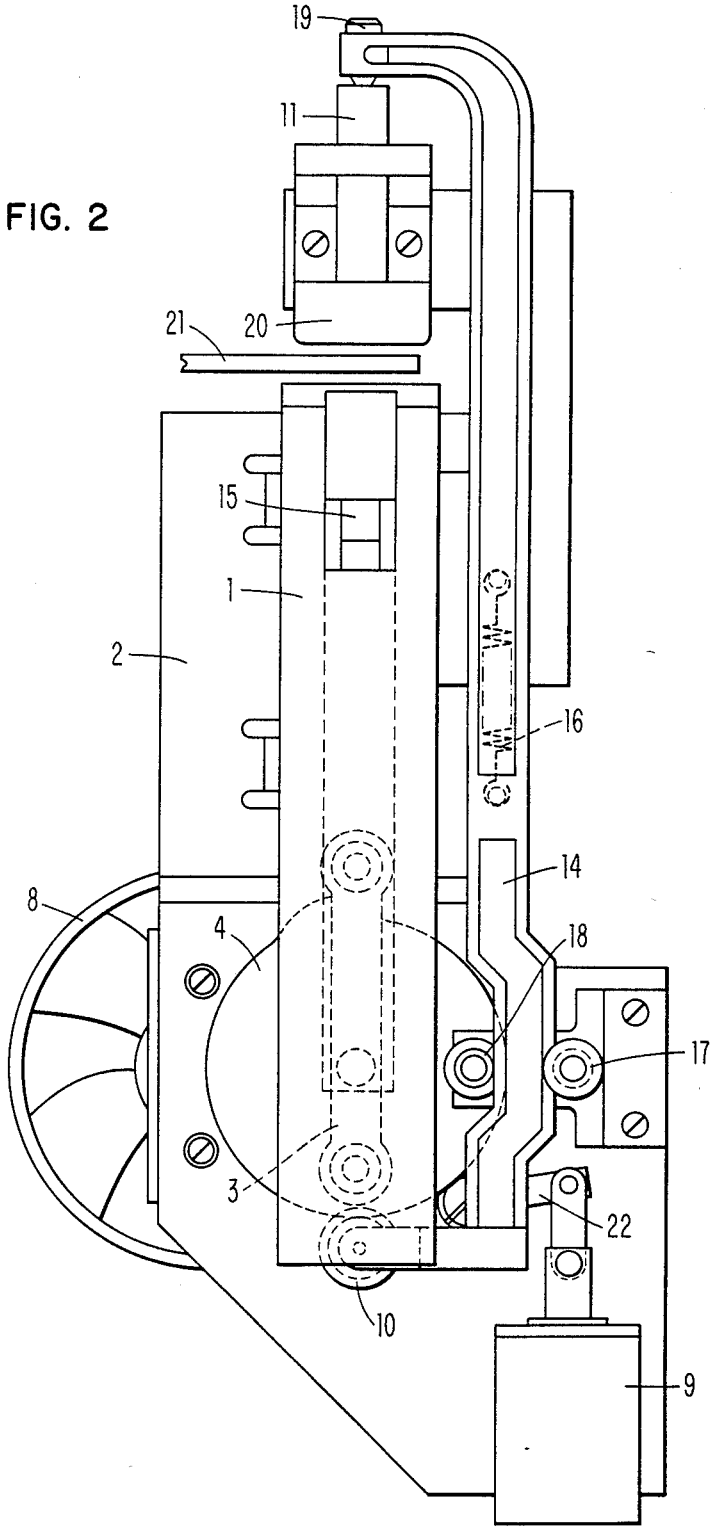
FIGS. 2–4 are front elevated views of the driver mechanism with the combination bellcrank and cam shown at various rotational positions of the driver operation.

In FIG. 2, the stapler mechanism 1 is shown with its driving bellcrank 3 at the lowest, i.e., starting, position. The clincher mechanism 11 is at its starting position, i.e., at the highest point of its travel. In this view, a coupling arm 14 between the cam follower 10 and the clincher 11 is shown. It is biased upwardly by a spring 16 and held in place by a pair of nylon (or similar material) guide rollers 17 and 18. The displacement between the clincher 11 and the connecting rod 14 can be adjusted by an adjustment screw 19.

When the solenoid 9 is activated, the single-revolution clutch (not visible in FIG. 2) is released and the combination bellcrank and cam follower 4 rotates in a clockwise direction (as viewed in FIG. 2).

Figure 3:
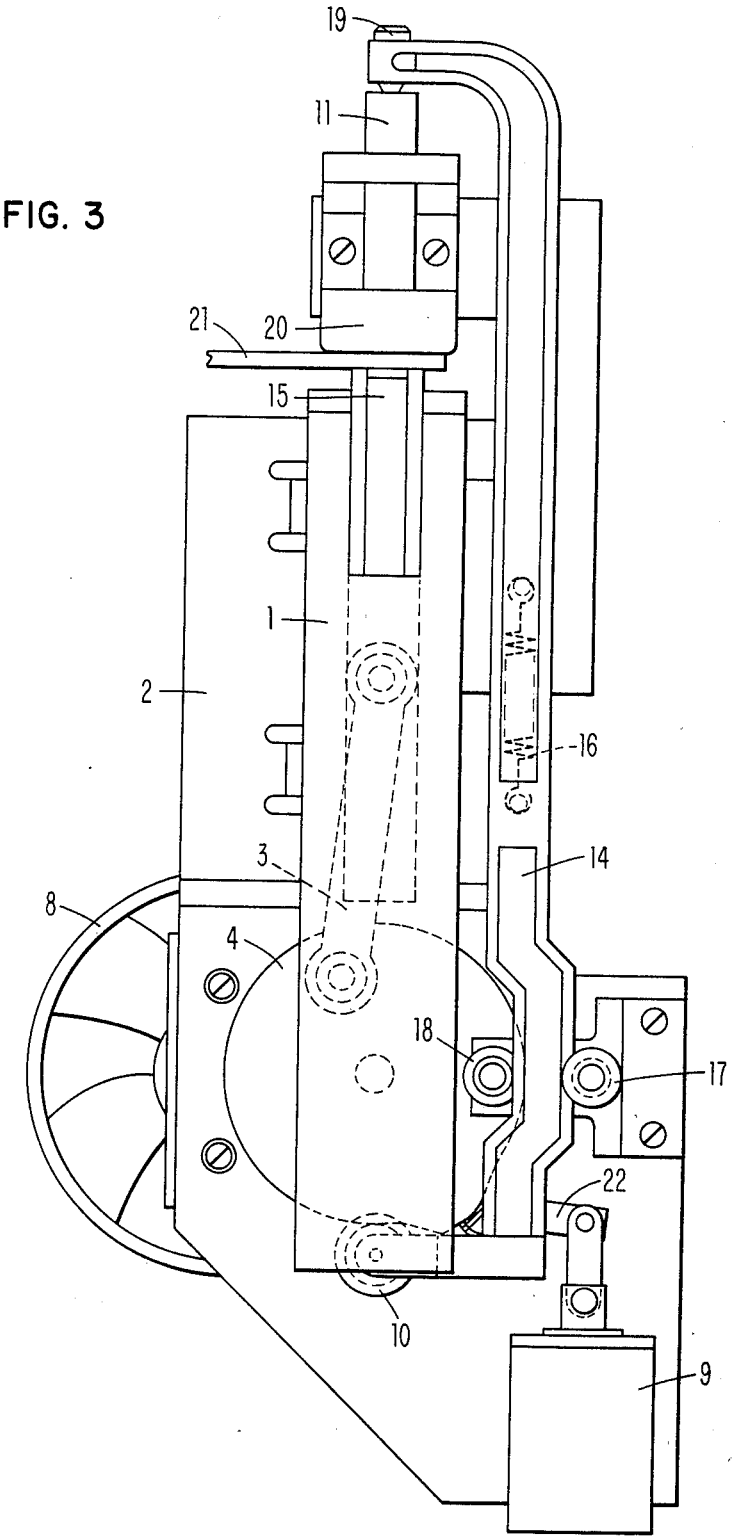

In FIG. 3, the stapling mechanism 1 is shown with the connecting rod 3 forcing a staple driver 15 upwardly against a clincher guide 20. The items to be stapled are placed between the stapler driver 15 and the clincher guide 20, which provides a back-up for the stapled items against the force of the staple driver 15. The clincher 11, however, has not yet operated at the position shown in FIG. 3.

Figure 4:
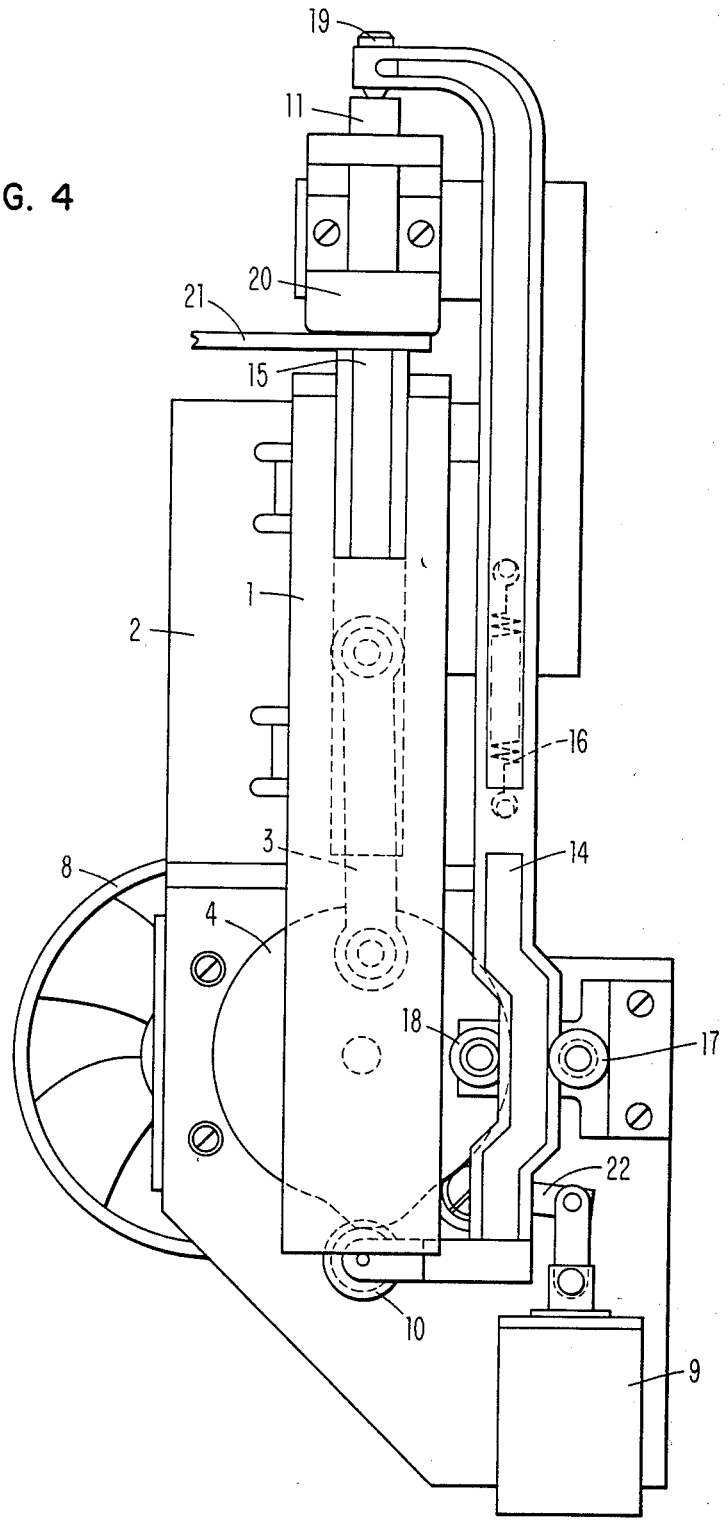

The operation of the clincher 11 via the coupling arm 14 from the cam follower 10 is shown in FIG. 4. The staple has been driven through the items to be stapled 21 and the clincher 11 is forced downwardly to bend over the ends of the driven staple.

The solenoid, now inactivated, permits a clutch dog 22 to reposition so as to cause the single-revolution clutch to disengage when the combination bellcrank and cam 4 has completed one revolution. If another stapling operation is not signaled by the controller of the apparatus to which the stapler is attached, then the motor is turned off to conserve energy.

What is claimed is:

1. A compact apparatus for driving and clinching a staple, comprising:

a stapler mechanism for driving a staple through articles to be stapled;

a clincher mechanism associated with said stapler mechanism and operable to clinch a staple which has been driven through the articles to be stapled;

a rotary motor including a rotary output shaft having two opposite ends extending out of opposite sides of said motor, said motor being adapted to be energized for a period of time exceeding the time necessary to drive and clinch a staple;

a flywheel mounted on one of said shaft ends, to thereby store energy in said flywheel as said shaft rotates;

an intermittently engaged single revolution clutch having input coupling means mounted on the other of said shaft ends, and having an output coupling means, said clutch being operable to deliver torque from said input coupling means to said output coupling means, for a single revolution of said clutch, when said clutch is engaged;

a rotary-to-linear converter having a rotary-movement input connected to the output coupling means of said clutch, having a first linear-movement output coupled to said stapler mechanism, and having a second linear-movement output coupled to said clincher mechanism, to thereby drive and clinch a staple during one revolution of said clutch; and means for momentarily engaging said clutch, said flywheel thereafter being operable to deliver energy to the output coupling means of said clutch during the one revolution of said clutch, as a staple is driven and clinched.

2. The invention as claimed in claim 1 wherein said rotary-to-linear converter comprises:

integral bellcrank means and cam means coupled to said clutch output coupling means;

wherein said first linear-movement output comprises connecting rod means coupling said bellcrank means to said stapler mechanism;

wherein said second linear-movement output comprises cam follower means coupling said cam means to said clincher mechanism; and spring means biasing said cam follower means against said cam means.

* * * * *